United States Patent [19]

Sherwood

[11] Patent Number: 4,834,542

[45] Date of Patent: May 30, 1989

[54] MIXER FOR PULVEROUS AND LIQUID MATERIALS (ESSENTIALLY CEMENT AND WATER), OF LIQUID-LIQUID MATERIALS

[75] Inventor: Ronald Sherwood, Terrenoire, France

[73] Assignee: Dowell Schlumberger Incorporated, Tulsa, Okla.

[21] Appl. No.: 227,476

[22] Filed: Aug. 1, 1988

Related U.S. Application Data

[63] Continuation of Ser. No. 28,377, Mar. 20, 1987, abandoned.

[30] Foreign Application Priority Data

Mar. 27, 1986 [FR] France ..... 86 04671

[51] Int. Cl.[4] ..... B01F 7/18; B01F 15/02; B28C 5/16; B28C 7/04

[52] U.S. Cl. ..... 366/21; 366/27; 366/65; 366/136; 366/163; 366/182; 366/263

[58] Field of Search ..... 366/21, 27, 183, 245, 366/40, 42, 51, 65, 293, 247, 136, 137, 163, 164, 342, 249, 165, 182, 194, 195, 196, 150, 263, 265, 279, 315, 262, 167, 317, 181, 2, 316, 173, 33, 34, 37, 177, 343, 244

[56] References Cited

U.S. PATENT DOCUMENTS

| | | | |
|---|---|---|---|
| 2,846,200 | 8/1958 | Jamison | 366/177 |
| 3,326,536 | 6/1967 | Zingg et al. | 366/17 |
| 3,339,897 | 9/1967 | Davis, Jr. | 366/265 |
| 3,638,917 | 2/1972 | Osten | 366/316 |
| 3,961,775 | 6/1976 | Markus | 366/265 |
| 3,994,480 | 11/1976 | Fothergill et al. | 366/165 |
| 4,184,771 | 1/1980 | Day | 366/165 X |
| 4,285,601 | 8/1981 | Miner | 366/165 X |
| 4,453,829 | 6/1984 | Althouse, III | 366/40 X |
| 4,453,832 | 6/1984 | Schumacher et al. | 366/167 |
| 4,592,658 | 6/1986 | Claxton | 366/265 |
| 4,614,435 | 9/1986 | McIntire | 366/165 |

*Primary Examiner*—Harvey C. Hornsby
*Assistant Examiner*—Scott J. Haugland
*Attorney, Agent, or Firm*—S. A. Littlefield

[57] ABSTRACT

The invention consists of a centrifugal mixer with an upper rotor (3) for projection of particles, which is hard-mounted to rotor (4) allowing centrifuging of fluid (15).

The invention lies in the creation of a low-pressure zone within the high-pressure zone of enclosure (23), for introduction of particles (20); this in turn requires the use of disturber (27).

The result is a remarkable degree of mixing of the water and cement and has applications for oil field services.

6 Claims, 4 Drawing Sheets

Figure 1:
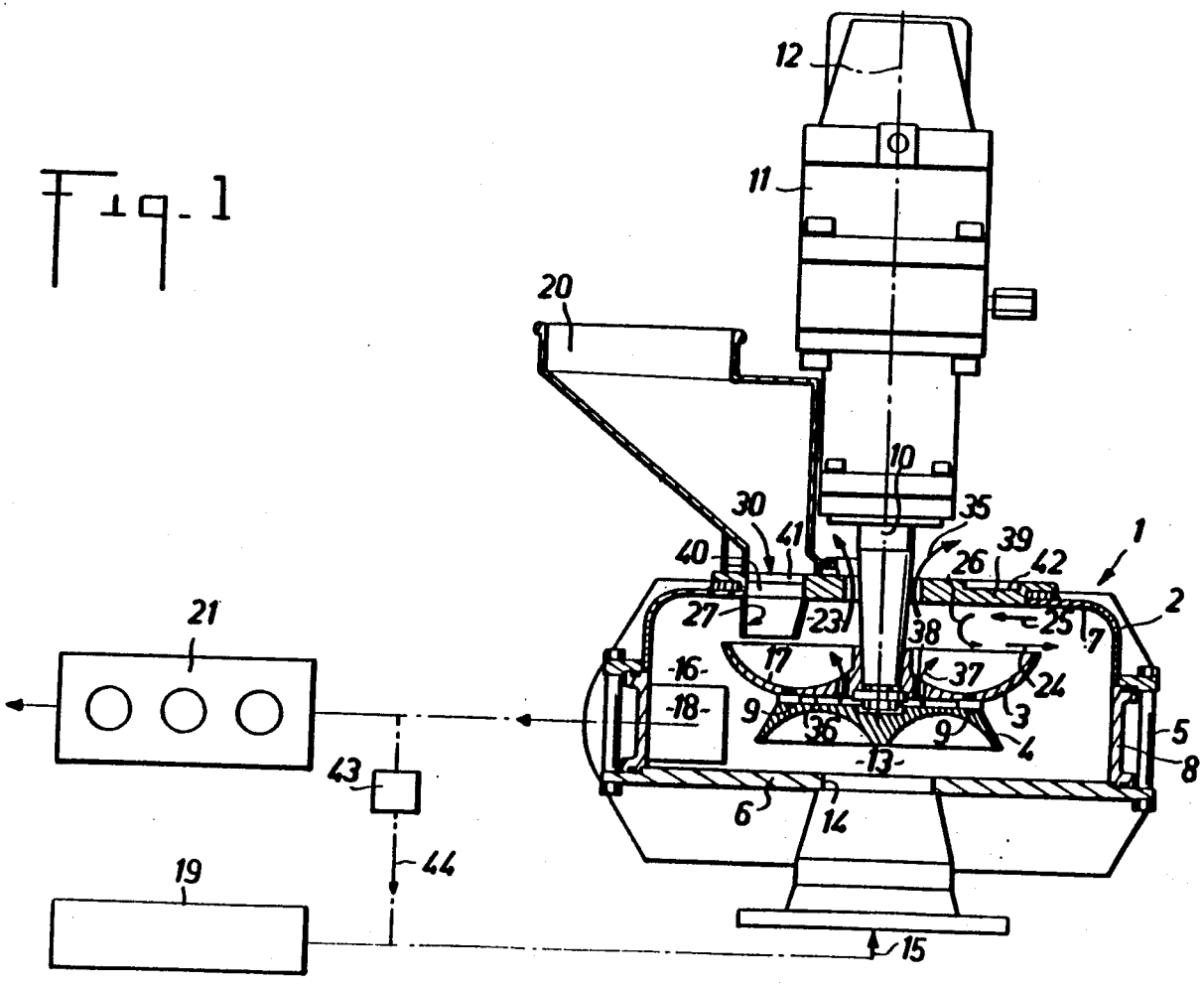

MIXER FOR PULVEROUS AND LIQUID MATERIALS (ESSENTIALLY CEMENT AND WATER), OF LIQUID-LIQUID MATERIALS

This is a continuation of application Ser. No. 028,377, filed on Mar. 20, 1987, now abandoned.

The invention consists of a device for mixing a pulverous material with a liquid, essentially, powdered cement and water. The application most particularly envisaged is the cementing of oil wells, gas wells, geothermal or other wells.

Such devices have existed for a long time, such as covered by patent U.S. Pat. No. 1,486,883 dating from 1922. The search for improved mix quality and refined production techniques has led to numerous publications, the most noteworthy certainly being patent U.S. Pat. No. 4,453,829.

The present document discusses a mixer with two rotors coupled within a single casing: an upper rotor receives granular material at its center by simple gravity feed through a hole in the center of the casing upper part. The rotor projects the material towards the peripheral zone. Liquid arrives through a central opening in the underside of the lower rotor, and is drawn in through the center of the rotor and delivered by centrifugal action to the rotor periphery. Mixing of the granular material and the liquid occurs in the peripheral zone between the two rotors, the mixture being drawn off through the casing by a suitable discharge system. The mixer thus described operates to full satisfaction when the granular material is sand and the liquid is a gel.

However, operation of the mixer was found to be less satisfactory with very fine pulverulents such as cement, and water.

In the first case, fine powders entrap a sizeable volume of air, which is freed in the peripheral mixing area of the equipment. This air cannot be centrifuged by the upper rotor, and thus cannot be evacuated from the casing with the finished mix; it thus collects in this area and gradually prevents correct operation of the mixer.

In the second case, materials such as sand lend themselves well to simple gravity feeding into the upper rotor, but the same is not true for fine powders, whose lower densities render them prone to pressure imbalances in this zone.

Furthermore, the equipment in question does not allow easy adjustments to the density of the mix obtained, while it is an established fact that successful cementing of oil wells depends on precise and easy density control of the cement used.

The purpose of the invention presented herein is to offer a mixer that operates in an extremely satisfactory manner, even with fine powders.

The invention in particular is intended to offer a mixer above all suited to cement powders and allowing for simple yet precise density control.

The mixer constituting the invention is of the "vortex" or "centrifuge" type, with a casing that contains the following sub-assemblies: a centrifugal rotor for projecting the pulverous material (or a second liquid-)—the centrifuging face of this rotor is radial to one wall of the casing (the preferred production method is with the rotor turned towards the upper wall); the rotor face and the casing wall plus the casing side walls define a "mixing area" around which a current of fluid (mixed or otherwise) is free to circulate under pressure; a pressurized fluid feed system delivering into the peripheral zone of the rotor, and a pulverous material feed system that includes a backup feed. communicating directly with the mixing area.

The invention allows forced feeding of the pulverous material by creating a (remarkably high) degree of negative pressure within the otherwise high-pressure peripheral zone of the mixing area.

This is achieved by means of a pulverous material feed device partially located in the high-pressure peripheral zone and containing an edge projecting a large distance from the casing wall so as to create local disturbances in the fluid flow and a zone of negative pressure downstream of the edge; the negative pressure zone communicates with the pulverous material backup feed.

The downstream negative pressure zone has the further advantage of communicating directly with the backup feed by means of an adjustable valve.

In one design, this "disturber" consists of a basically cylindrical pipe offset in relation to the rotor shaft.

In another design, the disturber is a circular pipe (shroud) coaxial with the rotor, and preferably flared downwards.

Means are provided for evacuating air from the casing, and in the preferred version, the mixer as detailed in the invention is of the general type described in patent U.S. Pat. No. 4,453,829, that is, also fitted with a fluid centrifuging rotor coupled to the pulverous material throwing rotor.

Nevertheless, the invention applies to all mixers operating with fluids and solid particles, comprising a casing that houses a high-speed rotor in turn containing an opening for delivery of liquid, a solid-particle feed system plus discharge duct through which the liquid/particle mix is drawn at greaterthan-atmospheric pressure. According to the invention, the solid particle feed system arrives inside the mixer as a projection from the casing wall, and in a zone where the fluid is in rapid rotation due to the effect of the rotor. The invention also covers mixing of two liquids, and mixing of solid particles with a saturated liquid.

On account of the pulverous material feed system covered by the invention, the mixing process can be regulated by a single parameter, for example, the pulverous material feed rate. Hence for the first time, it is possible to apply fully automated techniques to a cement mixer.

The feed system covered by the invention produces higher-quality mixes than obtained with present mixers, combined with increased efficiency for the following reasons.

Firstly, the stated system directly employs current forces and speeds existing within the mixer for drawing in the pulverous material.

In addition, the pulverous material is introduced directly into a zone of high turbulence, where mixing is most efficient. The material is thus able to shed the major part of the entrapped air.

As an example, the negative pressure zone might be at −0.6 bar while existing within a zone that is under 2.5 bar of pressure: this negative pressure enables the use of various pulverous material feed systems, including pneumatic or gravity feeds.

Figure 2:
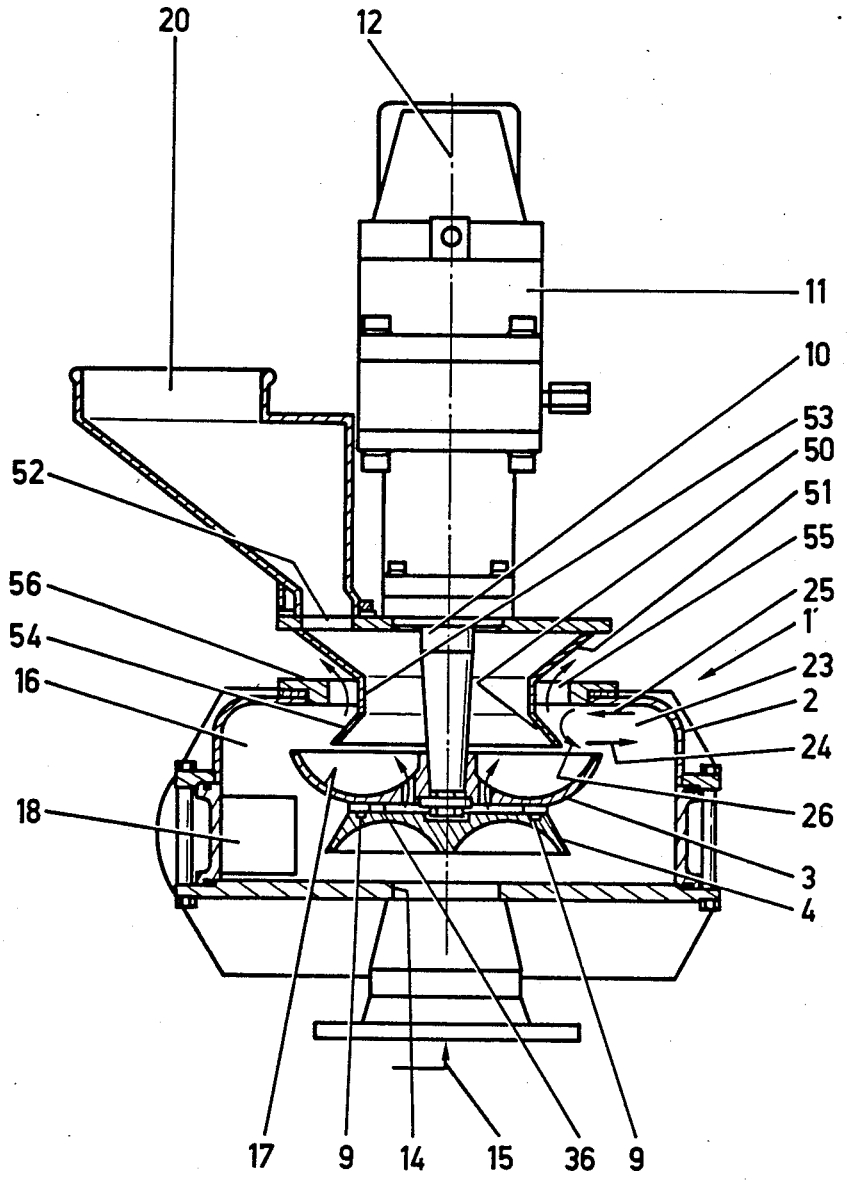
Figure 3:
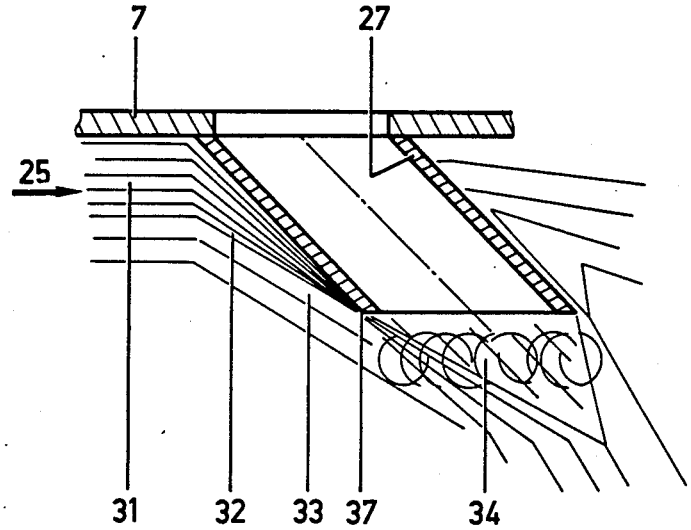
Figure 4:
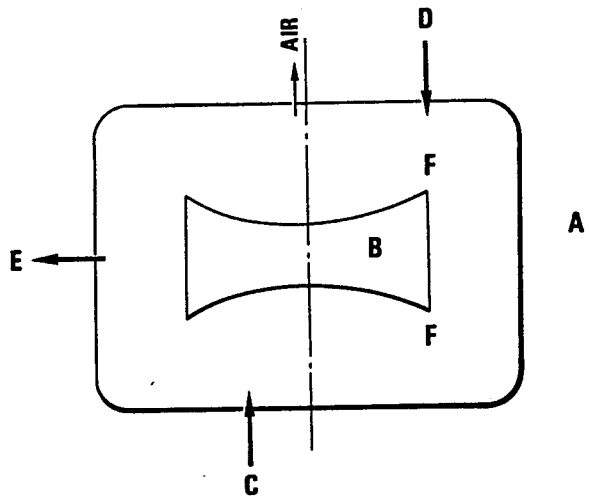

Other advantages and characteristics of the invention will be seen from the following description. Reference is made to the figures given in the annex, i.e.:

FIG. 1: partial cross-section of one variant of a mixer covered by the invention, with the mixing circuit shown schematically;

FIG. 2: partial cross-section of a second variant;

FIG. 3: schematic illustration of a disturber system as covered by the invention;

FIG. 4: functional diagram applicable to centrifugal mixers of the type covered by the invention.

FIG. 4 illustrates the general field of application of the invention. The centrifugal mixer consists of a casing (A) inside which rotor (B) rotates at high speed, such that a liquid fed in through duct (C) will be set into rapid rotation in one or several of mixing zones (F). The invention consists in creating a negative pressure in at least one of these zones, thus providing the feed of solid particles to the mixer, while making sure that solid particle feed system (D) delivers directly into zone (F) by means of a suitably configured design, off-mounted from the wall of the casing.

Reference is now made to FIGS. 1 through 3, which give greater detail of the variants produced with this invention.

In FIG. 1, mixer (1) has a casing (2) containing upper rotor (3) (also known as a "slinger") for throwing the pulverous material, and lower rotor (4) ("impeller") that pressurizes the liquid by centrifugal action.

Casing (2) is made in several parts to provide for easy assembly using attach parts (5). In the preferred version, the casing consists of lower wall (6) and upper wall (7), both of which are virtually flat and circular, and wall (8) which is cylindrical.

Rotors (3) and (4) are rigidly assembled to each other by attach parts (9), and installed on the end of rotor shaft (10). This assembly is driven by motor (11) which is mounted on a bracket (not shown), in turn fixed to the equipment chassis or to casing (2).

Lower rotor (4) is so designed that its rotation generates a vortex that in turn produces a zone of suction (13) in the region of lower orifice (14) located in the center of lower wall (6); inlet (15) (for water or more generally, any fluid flow, possibly saturated or containing additives) is mounted at this orifice—water is drawn in and impelled towards the peripheral zone of rotor (4) and generally distributed around the entire peripheral zone (16) of the mixer.

The upper ("throwing") face (17) of rotor (3) is essentially oriented in a transverse radial direction, that is, perpendicular to shaft (12). The face is toroidal, concave and directed towards upper wall (7) of the casing. The rotor can also be fitted to advantage with vertical blades (not shown) as per patent U.S. Pat. No. 4,453,829. The rotor centrifuging surface is designed to receive the pulverous material supplied by the feed system, and in rotation, impells the material by centrifugal force towards the rotor peripheral zone, and more generally, around mixer peripheral zone (16). The (pressurized) mix consisting of the fluid and the powder is evacuated through discharge duct (18) located in the mixer peripheral zone.

Mixer (1) is integrated into a mixing system consisting of mixing water tank (19) that delivers via inlet (15) in the lower part of the mixer; feed hopper (20) holding pulverous material, which is fed to the mixer by a system described below; high-pressure pump (21) which receives the mixture fed from discharge (18) (for example, slag cement) and delivers it to the work site (for example, oil well for cementing).

The above layout is a known method, and is described in patent U.S. Pat. No. 4,453,829; mention of it is made here for reference.

The invention centers on the appreciation of pressure phenomena and fluid dynamics inside volume (23) defined by the casing upper wall (7) and centrifuging face (17). The useful volume to be considered is that between the upper edge of face (17) (which coincides with the upper edge of the vertical blades), and flat wall (7). The height of this volume is generally about the same as that of the upper rotor itself, as given in paten U.S. Pat. No. 4,453,829. Nevertheless, it can be shown that the height of volume (23) can be one-half to twice the height of rotor (3).

Volume (23) contains an inner "pocket" subject to atmospheric pressure and surrounded by an area of relatively high pressure.

The sizes and relative positioning of these zones depends on mixer geometry (particularly, the shape of rotor (3) and the height of volume (23)), plus the rotational speed. Nonetheless, when the mixer is at normal operating speed, the pocket is generally confined to the centermost part of zone (23), and the high-pressure peripheral zone begins quite close to the center. It is naturally possible to establish a pressure schedule for zone (23) by the use of pressure sensors, for any given mixer.

The study of currents within zone (23) is a particularly difficult task. However, in simplified terms and without a specific governing theory, the following phenomena appear to exist. Firstly, the liquid and solid phases both feature high-speed rotation with a large tangential component, determined by the direction of rotation of the rotor. If the speed components are examined in a radial plane (for example, as shown in FIG. 1), a centrifugal radial current (arrow 24) is seen to exist in the immediate vicinity of upper rotor (3), directly created by the latter's rotation and a radial centripetal current (arrow 25) in the region of casing upper wall (7), created by reaction to centrifugal current (24).

Towards the center of the high-pressure zone, the flow has a vertically descending speed component (arrow 26) which links currents (25) and (24).

The invention provides for a pulverous material feed system with a device at least partially located in the high-pressure peripheral area, and consisting of a vane projecting to a large extent from casing upper wall (7) so as to create local disturbance in the current, thus increasing its speed in the edge upstream area and creating a zone of negative pressure downstream of the edge. This negative pressure zone communicates with the pulverous material feed system. It has been demonstrated that in spite of the very high speeds attained and the sensitive nature of the mixing phenomena at such speeds, the disturbance does not extend throughout the mixer volume (which would be detrimental to efficient mixing).

According to the design illustrated in FIG. 1, the disturbance device consists of a basically cylindrical pipe (27) mounted on wall (7). As shown in FIG. 3, the pipe can be mounted at a slant to the current (that is, radially (or towards the inside), and tangentially). It can also be mounted straightforwardly perpendicular to wall (7) (see FIG. 1). The pipe is attached to wall (7) by a clamp or by welding, and communicates with the bottom of the hopper; flow from the hopper is controlled by valve (30) (butterfly valve or slide valve, for example).

FIG. 3 illustrates the function of pipe (27). The pipe creates a local disturbance in the flow; beyond a certain distance from the pipe, the flow is not affected, which, in view of the high rotation speeds and the presence of saturated fluids circulating at rapid rates, is very surprising.

Within the finite disturbed zone, the disturbance can be analyzed roughly as follows. Firstly, the current enters the said volume as per the lines shown parallel to zone (31). On account of the protrusion formed by pipe (27) and its leading edge (37), the current lines progressively group towards zones (32) and (33); since the same flow has to pass through a smaller volume, the speed of the current increases, reaching a maximum in zone (33) bordering the leading edge. The current then diverges, creating a disturbed zone of low pressure immediately downstream of the leading edge. It then stabilizes until it leaves the disturbed zone completely. Low-pressure zone (34) communicates via pipe (27) with hopper (20), or at least with the section downstream of valve (30), and sucks in powder, which is then drawn along by a current of fluid and material directly into zone of turbulence (34).

This not only leads to improved mixing, but also gives more effective separation of the powder and entrapped air; the latter is able to escape from the mixer via the central zone of volume (23), that is, through the low-pressure pocket, where a passage is provided between shaft (10) and the upper wall of casing (2). The route taken by air escaping from the casing is shown by arrows (35).

Investigation of the above phenomena, in particular the fluid dynamics, will allow the specialist more easily to identify other equivalents to the stated geometry, particularly as regards disturber (27). The latter device could be mounted, moreover, a short way into the volume defined by throwing face (17)—in this case it would simply be necessary to limit the height of the vertical blades on rotor (3) (not illustrated).

Any air unable to escape from the powder during initial mixing as the powder arrives, will separate out during subsequent mixing in mixer outer limit (16), and will escape through passages connecting this area with the pocket in volume (23), via upper rotor (3). These passages may consist of cavity (36) between the respective rear sides of rotors (3) and (4), and ducts (38) traversing upper rotor (3) near its center. In this case, the route followed by the escaping air is shown by arrows (37) and (35).

Valve (30) can be of any type; it is an advantage if it takes the form of an annular plate (39) flush-seated into upper wall (7) so as to form part of the wall. The plate contains an opening (40) (an annular segment), which is blanked by slide valve (41) (a larger annular segment) that slides in annular track (42).

It is also possible to install a circulating line (44) between mixer offtake (18) and pump (21), thus enabling the mix to be returned to the start of the cycle, either because it has not reached the required density, or to allow density measurement in the return line by means of density meter (43).

The flow schedule for the mixer is written simply as: water inflow+cement inflow=mixer offtake.

During, for example, cementing of an oil well or similar, the volume of cement delivered by pump (21) is constant, and is determined by the pump speed. The rate of offtake of mixed material through (18) is constant, or can easily be maintained so.

As a result of the foregoing argument, and in view of the mixer flow schedule, water inflow (15) is a direct function of powder inflow (27), which can easily be controlled by valve (30).

It should be noted that it is in effect possible to control the flow of cement rather than the flow of water, since delivery of the former is forced, due to the suction effect created and to gravity, whereas water feed is not. The cement flow thus has priority over the water flow.

The above considerably simplifies the on-site operations necessary for precise control of slag cement density. With this invention, it is simply necessary to operate valve (30), and the water feed is automatically controlled. The site engineer can thus easily conserve a cement density value close to the optimum, throughout the cementing process, thereby largely increasing the chances of success of the operation.

Hopper (20) can be of the gravity feed or pneumatic type.

FIG. 2 shows a design variant (1') of the mixer illustrated in FIG. 1. Parts which are common to both have the same item numbers.

With this variant, the feed system contains shroud (50) surrounding the shaft and consisting in its upper part of truncated section (51) opening upwards to receive powder delivered from hopper (20) via valve (52); cylindrical center section (53) that penetrates casing (2); and truncated lower section (54) that opens downwards.

Circular space (55) is left between center section (53) and the upper wall of casing (2), to facilitate installation of shroud (50); this space is covered by circular cover plate (56), fitted to the wall;

The bottom edge of truncated lower section (54) reaches practically to the bottom of volume (23), as with the bottom edge of disturber (27) in FIG. 1, and its radial distance from shaft (10) is such as to place it inside the high-pressure peripheral area of volume (23), and not in the pocket.

Centripetal (radial) currents (25), and vertically descending currents (26) collide inside shroud (50), creating a zone of negative pressure just upstream of the edge of truncated lower section (54)—this means that the powder (feed regulated by valve (52)) is fed directly into the heaviest mixing area. Other equivalents to this geometry are also feasible.

Air escaping during this mixing process can exit through circular passage (55).

Valve (52) can be one of the types mentioned under FIG. 1. It is also possible to have a horizontal plate assembled to rotor (4), just below air exhaust space (36); this allows the high-pressure peripheral area to be divided into a fluid-rich area (below the plate) and a fluid-weak area (above the plate).

I claim:

1. A mixer for combining pulverous material and a fluid, comprising:

a housing having walls defining an inside volume and having an opening for receiving a fluid, an inlet for receiving pulverous material and an outlet;

a motor outside of the housing;

a rotor having a central shaft inside of the housing operatively connected to and driven by the motor, the rotor including an upper rotor and a lower rotor, the lower rotor facing the opening in the housing through which the fluid is drawn, the upper rotor facing the inlet for the pulverous material, the face of the upper rotor receiving the pulverous material and impelling it toward a peripheral zone of the housing;

a high pressure zone between the upper rotor and housing when the rotor is turning, the high pressure zone defined by a radial centrifugal current in the vicinity of the upper rotor, a radial centripetal current in the region of the casing's upper wall, and a vertically descending speed component linking the radial centrifugal current and the radial centripetal current, the high pressure zone located substantially over concave portions of the upper rotor;

a low pressure zone within the high pressure zone;

a feed hopper operatively attached to the housing for providing pulverous material through the inlet for it including a pipe extending off center from the central shaft into the high pressure zone above the concave portion of the upper rotor in the housing and including an outlet in the pipe, the pulverous material thereby being drawn into the housing by the low pressure zone and mixed with the fluid in the high pressure zone;

an outlet in the housing for expelling the mixed pulverous material and fluid; and a high pressure pump operatively attached to the outlet in the housing, the lower rotor when rotated producing a suction zone below it whereby the fluid is drawn in, impelled torward the lower rotor, distributed within the housing, and mixed with the pulverous material in an efficient manner.

2. The mixer of claim 1, wherein the face of the upper rotor is toroidal and directed toward the inlet for the pulverous material.

3. The mixer of claim 2, wherein the pipe is set at an angle relative to the shaft connecting the motor and the rotor, the pipe thereby creating a disturbance of high and low pressure zones.

4. The mixer of claim 1, wherein the pipe is a shroud surrounding a drive shaft connecting the motor and the rotor, and facing into the upper rotor.

5. The mixer of claim 2, wherein there is an adjustable valve at the outlet of the feed hopper so that the amount of pulverous material may be adjusted to insure complete mixing.

6. The mixer of claim 2, wherein the fluid is water.

* * * * *